US011661680B2

(12) United States Patent
Stephan et al.

(10) Patent No.: US 11,661,680 B2
(45) Date of Patent: May 30, 2023

(54) SPINNING MACHINE

(71) Applicant: Maschinenfabrik Rieter AG, Winterthur (CH)

(72) Inventors: Adalbert Stephan, Beilngries/Paulushofen (DE); Julian Reuthlinger, Ingolstadt (DE)

(73) Assignee: Maschinenfabrik Rieter AG, Winterthur (CH)

( * ) Notice: Subject to any disclaimer, the term of this patent is extended or adjusted under 35 U.S.C. 154(b) by 44 days.

(21) Appl. No.: 17/197,348

(22) Filed: Mar. 10, 2021

(65) Prior Publication Data

US 2021/0285131 A1 Sep. 16, 2021

(30) Foreign Application Priority Data

Mar. 11, 2020 (DE) ..... 10 2020 106 675.9

(51) Int. Cl.
*D01H 15/00* (2006.01)
*D01H 9/00* (2006.01)

(52) U.S. Cl.
CPC ..... *D01H 15/00* (2013.01); *D01H 9/008* (2013.01)

(58) Field of Classification Search
CPC ..... D01H 15/00; D01H 4/48; D01H 4/50; D01H 4/52; D01H 9/00; D01H 9/005; D01H 9/008; B65H 67/08
See application file for complete search history.

(56) References Cited

U.S. PATENT DOCUMENTS 4,774,806 A * 10/1988 Stahlecker ..... D01H 4/16 57/411
5,293,739 A * 3/1994 Brockmanns ..... D01H 9/008 57/263
5,343,686 A * 9/1994 Buchner ..... D01H 9/008 57/352
5,600,945 A * 2/1997 Schmidke ..... D01H 11/00 57/263

(Continued)

FOREIGN PATENT DOCUMENTS

DE 40 35 439 A1 5/1992
DE 42 04 044 A1 2/1993

(Continued)

OTHER PUBLICATIONS

EPO Search Report, dated Jul. 27, 2021.
German Patent Office Search Report, dated Jan. 15, 2021.

*Primary Examiner* — Shaun R Hurley
*Assistant Examiner* — Patrick J. Lynch
(74) *Attorney, Agent, or Firm* — Dority & Manning, P.A.

(57) ABSTRACT

A spinning machine includes a plurality of adjacently arranged spinning stations, wherein carrier devices for a fiber bundle are assigned to the spinning stations. Each spinning station operating with a fiber bundle feed device and a fiber bundle piecing device. The fiber bundle piecing device includes a sliver pickup configured to grasp and pick up a leading end of the fiber bundle from the carrier device and a supply device configured to move the leading end of the fiber bundle to the feed device. The piecing device with the sliver pickup and the supply device is at a fixed stationary position relative to the spinning stations and is assigned to a single spinning station or a group of spinning stations.

11 Claims, 8 Drawing Sheets

(56) References Cited

U.S. PATENT DOCUMENTS

| | | | | |
|---|---|---|---|---|
| 5,636,411 | A * | 6/1997 | Greis | D01H 9/008 57/353 |
| 2007/0028585 | A1* | 2/2007 | Grecksch | D01H 4/50 57/404 |
| 2014/0283496 | A1* | 9/2014 | Stahlecker | D01H 15/00 57/263 |
| 2020/0080238 | A1* | 3/2020 | Ueding | D01H 9/008 |

FOREIGN PATENT DOCUMENTS

| | | | | |
|---|---|---|---|---|
| DE | 43 21 367 | A1 | 6/1994 | |
| DE | 19858986 | A1 * | 6/2000 | D01H 15/013 |
| DE | 10 2005 009 766 | A1 | 9/2006 | |
| DE | 10 2018 121 906 | A1 | 3/2020 | |
| EP | 3 620 560 | A1 | 3/2020 | |

* cited by examiner

SPINNING MACHINE

FIELD OF THE INVENTION

The present invention relates to a spinning machine with a plurality of adjacently arranged spinning stations, wherein each spinning station includes a feed device for a fiber bundle. Carrier devices for the fiber bundle are assigned to the spinning stations, and with a piecing device for the fiber bundle. The piecing device includes at least one sliver pickup for grasping and picking up a leading end of the fiber bundle and a supply device for supplying the leading end of the fiber bundle to the feed device.

BACKGROUND

DE 10 2005 009 766 A1 describes a service unit for fiber-processing textile machines with a plurality of workstations, which includes a handling device for manipulating sliver. The handling device grasps the sliver with the aid of a suction tube and a mechanical and/or pneumatic holding device for the sliver. The suction tube has a flattened suction tube opening, with which a sliver end hanging over a can may be drawn in across a relatively wide area. It is disadvantageous in this case that the service unit must be called to the spinning station and, possibly, must cover a very long distance along the entire spinning machine. Due to the time consumed therefor, the efficiency of the spinning station decreases.

DE 42 04 044 A1 describes a manipulator, which includes, at its free end, a suction nozzle for picking up and holding the leading end of a sliver. The sliver is held at the can in a clamp, and so the end of the sliver is always to be found at a defined position. The manipulator can therefore grip specifically at this point and grasp the sliver. It is disadvantageous in this case that each can must be equipped with a clamp and the can must have been placed in a certain direction of rotation at the machine, so that the manipulator can find the sliver end. In addition, the manipulator, which is displaceable along the machine, must be positioned highly accurately with respect to the spinning station, in order to be able to transfer the sliver to the spinning station.

DE 43 21 367 A1 describes a device for automatically placing a sliver onto a feed device of a textile machine with a maintenance device. The sliver is grasped and supplied to the spinning machine. The grasping of the sliver is facilitated due to the fact that so-called elongate cans are utilized, which are located only under a single spinning station and have a width that is less than the width of the spinning station itself. As a result, the area in which the sliver end can be located is limited. This maintenance device also serves the entire spinning machine and, therefore, has long approach paths. This is time-consuming and blocks the spinning station for a very long time, until it can start spinning again with a new sliver.

A problem addressed by the present invention is therefore that of creating a spinning machine, with which the described disadvantages are to be avoided, in order to increase the efficiency of the spinning stations.

SUMMARY

The problem is solved by a spinning machine having the features set forth herein.

Additional objects and advantages of the invention will be set forth in part in the following description, or may be obvious from the description, or may be learned through practice of the invention.

In the case of a spinning machine according to the invention with a plurality of adjacently arranged spinning stations, each spinning station includes a feed device for a fiber bundle. Carrier devices for the fiber bundle are assigned to the spinning stations. A piecing device for the fiber bundle includes at least one sliver pickup for grasping and picking up a leading end of the fiber bundle and a supply device for supplying the leading end of the fiber bundle to the feed device. The piecing device with the sliver pickup and the supply device is situated in an at least partially stationary manner at the spinning machine, preferably at each spinning station, and is assigned to a single spinning station or a group of spinning stations.

An appropriate spinning machine can be a rotor spinning machine, an air-jet spinning machine, or a ring spinning machine. In a rotor spinning machine, a feed device generally includes a feed roller and an opening roller. A fiber bundle is supplied to the feed device and is opened into individual fibers by the opening roller. Thereafter, the fibers are transferred to a rapidly rotating rotor, in which a yarn is spun. In the case of an air-jet spinning machine or a ring spinning machine, the fiber bundle is supplied to a drafting system as the feed device and is thinned by the drafting system. Thereafter, the thinned fiber bundle is transferred to an air-jet spinning nozzle or a ring-traveller system.

Carrier devices for the fiber bundle are either cans, in which the fiber bundle is deposited cycloidally, or bobbins, onto which the fiber bundle is wound.

According to the invention, the piecing device with the sliver pickup and the supply device is situated at the spinning machine in such a way that it can piece a new fiber bundle onto the old, outgoing fiber bundle, or replace this, in a very short time at the spinning station. For this purpose, the fiber bundle, in particular the leading end of the new fiber bundle, is first grasped and picked up at its carrier device by the piecing device. Thereafter, the leading end of the fiber bundle is supplied to the feed device. This can take place by means of swivel movements or by means of translatory movements of the sliver pickup together with the leading end of the fiber bundle. Depending on the type of the feed device, the leading end of the fiber bundle is transferred to the feed device in a different way. For example, the leading end of the fiber bundle can be brought into a position of readiness, from which it is supplied to the feed device after the presently spun fiber bundle runs out. However, it can also be placed, blown, or sucked directly into the feed device, for example.

In order to be able to carry out the piecing operation promptly when the old fiber bundle runs out, it is provided according to the invention that the piecing device with the sliver pickup and the supply device is situated at the spinning machine in an at least partially stationary manner. It is particularly advantageous when a piecing device is present at every spinning station. It is also advantageous, however, when the piecing device is provided in a partially stationary manner. This means it is secured at the spinning machine in the direct proximity of the spinning stations and can travel only short paths to the spinning station that requests a piecing of a fiber bundle. The piecing device is assigned to a single spinning station or a group of spinning stations. A group of spinning stations can be, for example, the number of spinning stations that are situated in one section of the spinning machine and can include, for example, 8 to 12 spinning stations. It is conceivable that the piecing device is partially secured at the section, for example, with a guide device, at which the sliver pickup and the supply device are displaceably situated. The simplest and fastest design of the piecing device, however, consists of each individual spinning station having its own piecing device. Therefore, a guide device for moving the sliver pickup and the supply device is not necessary. The piecing device can carry out the piecing of the fiber bundle directly at its spinning station.

It is particularly advantageous when the piecing device also includes an insertion device for inserting the leading end of the fiber bundle into the feed device. Therefore, the leading end of the fiber bundle is not only picked up from the carrier device and supplied to the feed device, it is additionally inserted into the feed device by the piecing device. The insertion device can include, for example, blowing nozzles, suction nozzles, or mechanical supply elements for this purpose. When the leading end of the fiber bundle is located in the proximity of the feed device, the leading end of the fiber bundle is inserted, by the insertion device, into the feed device in such a way that the feed device can continue spinning with the new fiber bundle.

Moreover, it is advantageous when the fiber bundle is a sliver or a roving, which is deposited into cans, which are set up in at least one row at the spinning stations, or when the sliver is a roving wound onto bobbins. In the case of a rotor spinning machine, a sliver is generally supplied to the feed device. Alternatively, a roving can also be supplied. Roving is understood to be an intermediate product, which is utilized as a starting product for end spinning processes, such as, for example, ring spinning, air-jet spinning, or rotor spinning. During the manufacture of roving, it is important that the yarn twist, on the one hand, is so minor that it can be opened again in the end spinning process and, on the other hand, is sufficiently great to ensure a secure transport and an interference-free supply to the end spinning process. The sliver or the roving is opened into individual fibers in the feed device and the downstream opening roller of the rotor spinning machine and, thereafter, spun into a yarn. A roving is generally presented to an air-jet spinning machine or a ring spinning machine. It is inserted into a drafting system, further drafted there, and subsequently spun into a yarn. In the simplest case, the leading end of the sliver or of the roving is withdrawn from the can or sought on the package and picked up. In further embodiments, it is also possible that the leading end of the fiber bundle is deposited at the can or the bobbin at a defined location and secured there, if necessary, so that it can be quickly and easily found and picked up by the sliver pickup.

It is also advantageous when the piecing device is situated in a separate unit, in particular between two spinning stations. If the piecing device is situated between two spinning stations, it can be configured for serving only one spinning station. However, it can also be provided for piecing the fiber bundle at two adjacent spinning stations. In particular when a separate unit is provided, the unit can be integrated, for example, between two adjacent spinning stations in the spinning machine. Even though the spinning machine becomes longer as a result, it is therefore possible that wider cans or bobbins with greater capacity are utilized at the spinning station. In addition, the unit can be modularly integrated into the spinning machine. In another embodiment, the separate unit can also be designed in such a way that it is mounted, for example, under the spinning station, and, from there, picks up the fiber bundle and supplies it to the feed device.

It is also advantageous when the piecing device includes a preparation device for the improved insertion of the leading end of the fiber bundle into the feed device. By means of a preparation device, the leading end of the fiber bundle can be prepared in such a way that it can be automatically taken up by the feed device and the further spinning can be continued without great delay.

It is also advantageous when the preparation device includes a pointing device and/or a splicing device for the leading end of the fiber bundle. By means of the pointing device, the leading end of the fiber bundle is prepared in such a way that it can be inserted as far as possible into the feed device. The insertion of the fiber bundle into a loop catcher, which prevents loops from forming in the fiber bundle while being drawn into the feed device, which could cause the fiber bundle to tear, can also be improved as a result. A splicing device is advantageous for the case in which the leading end of the new fiber bundle is to be joined with the end of the old fiber bundle, which is still entering the feed device. With the splicing device, the leading end and the end of the two fiber bundles are joined to each other. Therefore, the end of the old fiber bundle automatically draws the leading end of the new fiber bundle into the feed device. Possible thick places, which arise in the fiber bundle as a result, can be cleaned with the subsequently spun yarn.

It is also advantageous when the piecing device includes a sliver separating unit for separating a residual sliver section of the outgoing fiber bundle. In many cases, it is desirable that the entire old fiber bundle not be used up, since this could possibly produce defective places in the yarn. In this case, the outgoing old fiber bundle is detached at a predetermined point in time and at a residual length of the outgoing fiber bundle remaining as a result. This separation can take place, for example, by means of producing clamping points at the fiber bundle that move away from each other, or by means of air blasts that act upon the old fiber bundle.

It is also advantageous when the sliver pickup cooperates with a sliver holder and the supply device. The sliver pickup can transfer the grasped sliver to the supply device when the sliver pickup and the supply device are separate devices. The supply device can also be integrated into the sliver pickup, however. Which design is selected depends essentially on the structural conditions at the spinning station.

The cooperation with a sliver holder is advantageous particularly for the case in which the fiber bundle is situated at the can, the bobbin, or the spinning station in a defined position in the sliver holder and, there, can be grasped by the sliver pickup. The sliver holder makes it easy for the sliver pickup to find the leading end of the fiber bundle, since, as a result, it knows the position of the leading end of the fiber bundle and can pick up the leading end of the fiber bundle specifically at this point.

Particular advantages result when the sliver pickup and/or the insertion device are/is situated at the supply device. By means of the supply device, the sliver pickup and/or the insertion device can be brought into the suitable position, in order to be able to pick up the fiber bundle and transfer it to the feed device in an optimal manner. The supply device is capable, for example, of approaching the necessary position by means of rotational movements and/or translatory movements and appropriately transporting the fiber bundle.

It is also advantageous when the insertion device includes pneumatic and/or mechanical conveying means. Pneumatic conveying means, for example, suction nozzles and/or blowing nozzles, are frequently suitable for moving the leading end of the fiber bundle in a direction, in which it can be inserted into the feed device or a loop catcher in an optimal manner. Mechanical conveying means, such as, for example, movable clamps or grippers or conveyor belts, however, are capable of bringing the leading end of the fiber bundle to a certain position in a controlled manner.

It is also advantageous when the supply device for the fiber bundle is coupled to a thread-handling device and/or to a housing cover of the spinning station. The thread-handling device or the housing cover are usually present at the spinning stations and are designed to be movable. The possibilities of movement of the thread-handling device or of the housing cover can be utilized in order to also grasp the leading end of the fiber bundle and supply it to the feed device and insert it into the feed device.

Moreover, it is advantageous when the piecing device cooperates with auxiliary units, which are situated at devices that are displaceable along the spinning machine. These auxiliary units are, for example, insertion devices or preparation devices, which are not situated at the piecing device itself, but rather, for example, at maintenance devices, which are displaceable along the spinning machine and perform further tasks, such as, for example, carrying out a can change or performing cleaning tasks at the spinning stations. These types of auxiliary units can also be utilized for carrying out preliminary tasks that facilitate the subsequent pick-up of the fiber bundle or the supply or insertion of the fiber bundle, such as, for example, placing the leading end of the fiber bundle into a sliver holder.

It is also advantageous when the piecing device includes a displacement device for reaching multiple spinning stations. Such a displacement device is, for example, a rail, at which the piecing device is situated, and a drive for the piecing device. The rail can be secured along multiple spinning stations, preferably along the spinning stations of one section of the spinning machine, so that the piecing device is displaceable along the rail and can serve the spinning stations of this section.

BRIEF DESCRIPTION OF THE DRAWINGS

Further advantages of the invention are described in the following exemplary embodiments. Wherein.

DETAILED DESCRIPTION

Figure 1:
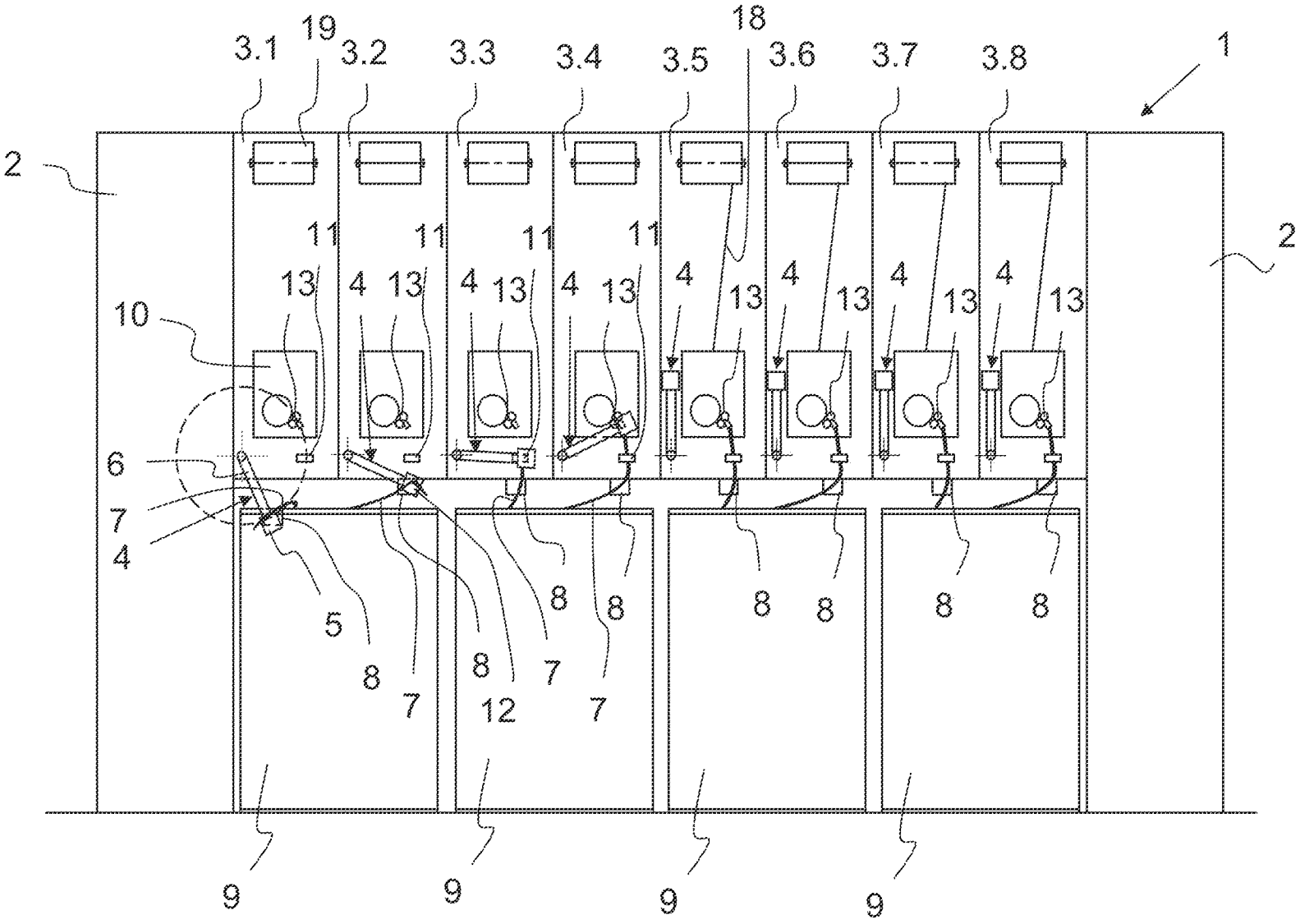
FIG. 1 shows a side view of a spinning machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the alternative exemplary embodiments represented in the figures, the same reference signs are utilized for features that are identical or at least comparable in terms of their configuration and/or mode of operation. Provided the features are not described in detail again, their design and/or mode of operation correspond/corresponds to the design and mode of operation of the above-described features.

FIG. 1 shows a side view of a spinning machine 1 according to the invention, in this case a rotor spinning machine. Eight spinning stations 3.1 through 3.8 are situated between two end stocks 2. In the case of rotor spinning machines, several hundred such spinning stations 3.1 through 3.8 can be adjacently arranged on each side of the machine. They are generally divided into individual, adjacently arranged sections, each with 8 to 12 spinning stations 3.1 through 3.8. Each of the spinning stations 3.1 through 3.8 includes a spin box 10, in which a thread 18 is spun and wound onto a yarn package 19. In addition, each of the spinning stations 3.1 through 3.8 includes a separate piecing device 4. A sliver pickup 5 and a supply device 6, which are schematically represented, are situated at each piecing device 4. While the piecing devices 4 of the spinning stations 3.5 through 3.8 are in their neutral position, the piecing devices 4 of the spinning stations 3.1 through 3.4 are represented in various working positions.

The piecing device 4 is designed to be pivotable, as indicated by the circle represented with a dashed line at the spinning station 3.1. The pivoting motion can either take place about 360 degrees, or it can also be limited to the area of the separate spinning station 3.1 through 3.8. The sliver pickup 5 is capable of picking up a leading end of a fiber bundle 7 from a sliver holder 8. In the exemplary embodiment of the spinning station 3.1, this sliver holder 8 is situated at a can 9 set up under the spinning station 3.1. The cans 9 of the individual spinning stations 3.1 through 3.8 are arranged in two rows, one behind the other. With respect to the remaining spinning stations 3.2 through 3.8, the sliver holder 8 is located at an underside of the particular spinning station 3.2 through 3.8. As is apparent at the spinning station 3.2, the sliver pickup 5 picks up the leading end of the fiber bundle 7 at this sliver holder 8 arranged under the spinning station 3.2. The sliver holder 8 can also be arranged at another suitable point, however.

As soon as the sliver pickup 5 has picked up the leading end of the fiber bundle 7, the supply device 6 pivots upward in the direction of a spin box 10 of the spinning station 3.1 through 3.4. At this, the piecing device 4 stops the corresponding spinning position 3.3 in the area of a loop catcher 11. An insertion device 12 arranged at the piecing device 4 ensures that the leading end of the fiber bundle 7 is threaded into the loop catcher 11. The loop catcher 11 can be designed in the manner of an eyelet or can include a lateral opening, into which the fiber bundle 7 is inserted.

Finally, as represented with respect to the spinning station 3.4, the piecing device 4 pivots further in the direction of the spin box 10, at which a feed device 13 is located. At this feed device 13 as well, the insertion device 12 ensures that the leading end of the fiber bundle 7 is inserted into the feed device 13. The insertion device 12 can open the feed device 13, for example, so that the insertion process can be more easily carried out.

Figure 2A:
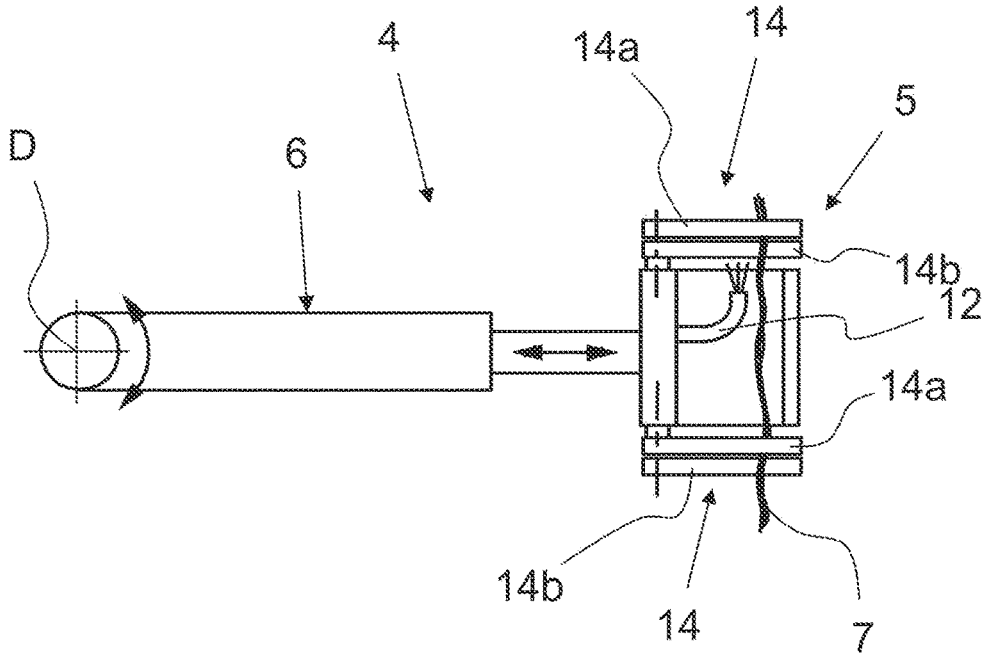
FIG. 2*a* shows a section of a side view of a piecing device.

In FIG. 2*a*, a side view of a piecing device 4 is represented. The piecing device 4 is mounted so as to be rotatable about a rotational axis D. It includes the sliver pickup 5 and the supply device 6. The sliver pickup 5 is arranged at the supply device 6 and can be brought into the necessary position, by means of the supply device 6, in order to pick up a fiber bundle 7, for example, from a sliver holder 8 and supply it to a loop catcher 11 and a feed device 13 (see FIG. 1). The supply device 6 is rotatable about the rotational axis D and, as necessary, can also be designed to be variable in length, in order to be able to carry out a translatory motion. The sliver pickup 5 includes the insertion device 12, which is designed as a blowing nozzle in this case. With this blowing nozzle, a fiber bundle 7, which is clamped between two jaws 14*a*, 14*b* of each of two grippers 14, can be manipulated. Due to an appropriate control of the two grippers 14 and the insertion device 12, the leading end of the fiber bundle 7 can be inserted into the feed device 13.

Figure 2B:
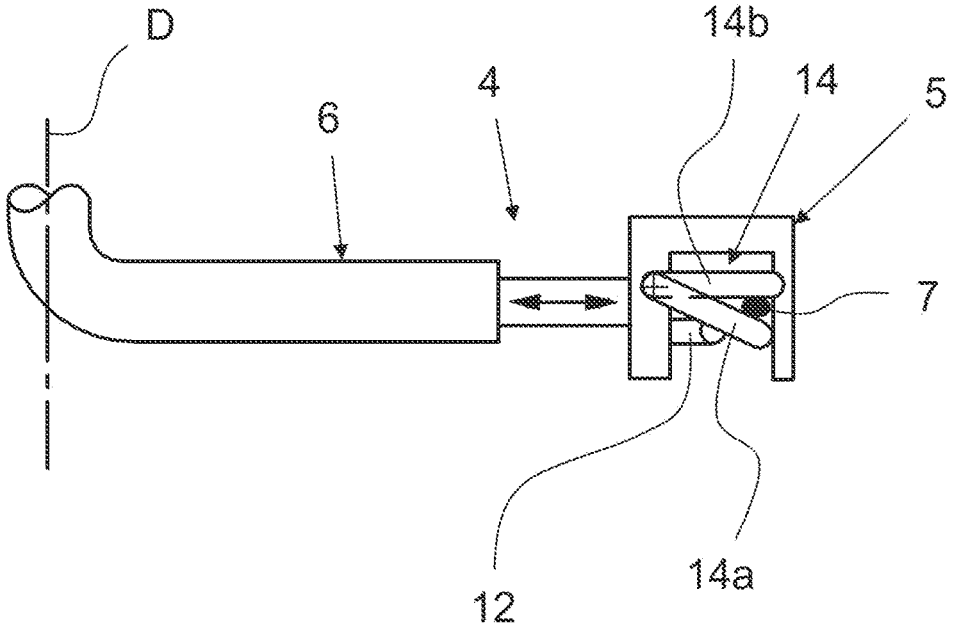
FIG. 2*b* shows a top view of the piecing device according to FIG. 2*a;*

FIG. 2*b* shows a top view of a piecing device 4 according to FIG. 2*a*. Therein, it is apparent that the sliver pickup 5 is designed in a U-shape in this exemplary embodiment. The fiber bundle 7, which is clamped between the two jaws 14*a* and 14*b* of the gripper 14, is located within the U-shape of the sliver pickup 5. By means of the insertion device 12, the leading end of the fiber bundle 7 can be inserted into the loop catcher 11 or the feed device 13. In order to be able to accurately position the leading end of the fiber bundle 7, in this exemplary embodiment, the gripper 14 is capable of moving the two jaws 14*a* and 14*b* jointly or separately. The two jaws 14*a* and 14*b* can also generate a separation of the fiber bundle 7 with a suitable control. This is significant, in particular, for the case in which a residual length of the old fiber bundle is to be detached.

Due to a suitable control of the jaws 14*a*, 14*b* or of the suction nozzle of the insertion device 12, these aforementioned components form a preparation device, a pointing device, or a sliver separating unit. In addition, a splicing device can also be integrated in the sliver pickup 5, with which the leading end of the new fiber bundle 7 is pneumatically joined with the end of the old fiber bundle.

Figure 3:
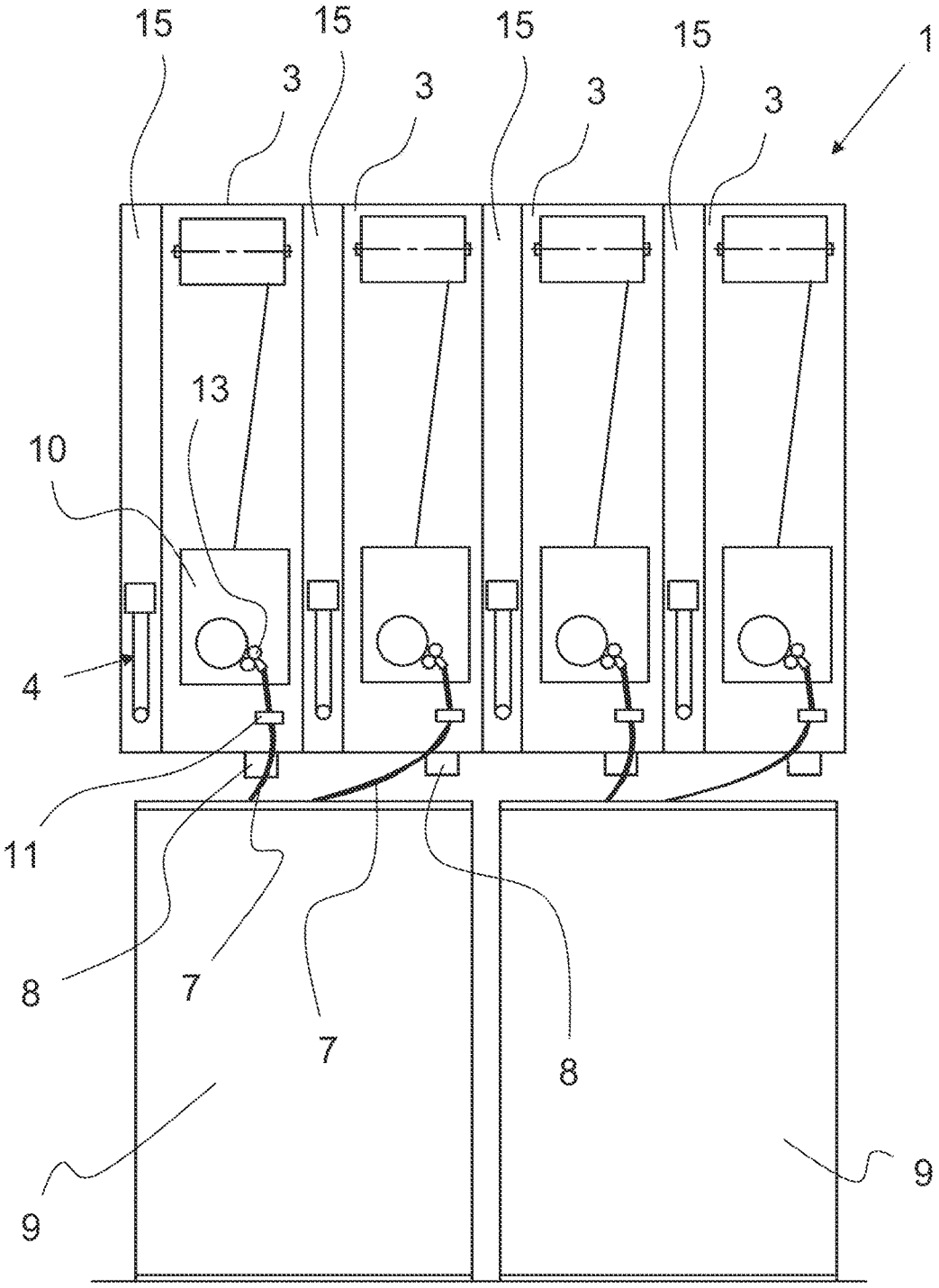
FIG. 3 shows a section of a side view of a spinning machine according to the invention with separate units for the piecing device.

In FIG. 3, a section of a side view of a spinning machine 1 according to the invention is represented with separate units 15 for the piecing device 4. The particular associated unit 15 is arranged laterally next to each spinning station 3. The unit 15 includes the piecing device 4 and, if necessary, control and drive elements. The spinning station 3 and the unit 15, together, are wider than only a single spinning station 3. Although this lengthens the spinning machine 1, it makes it possible for larger cans 9 to be positioned under the spinning machine 1. These larger cans 9 have a larger capacity for a fiber bundle 7, as the result of which a changeover of the fiber bundle 7 is to be expected less often.

Figure 4:
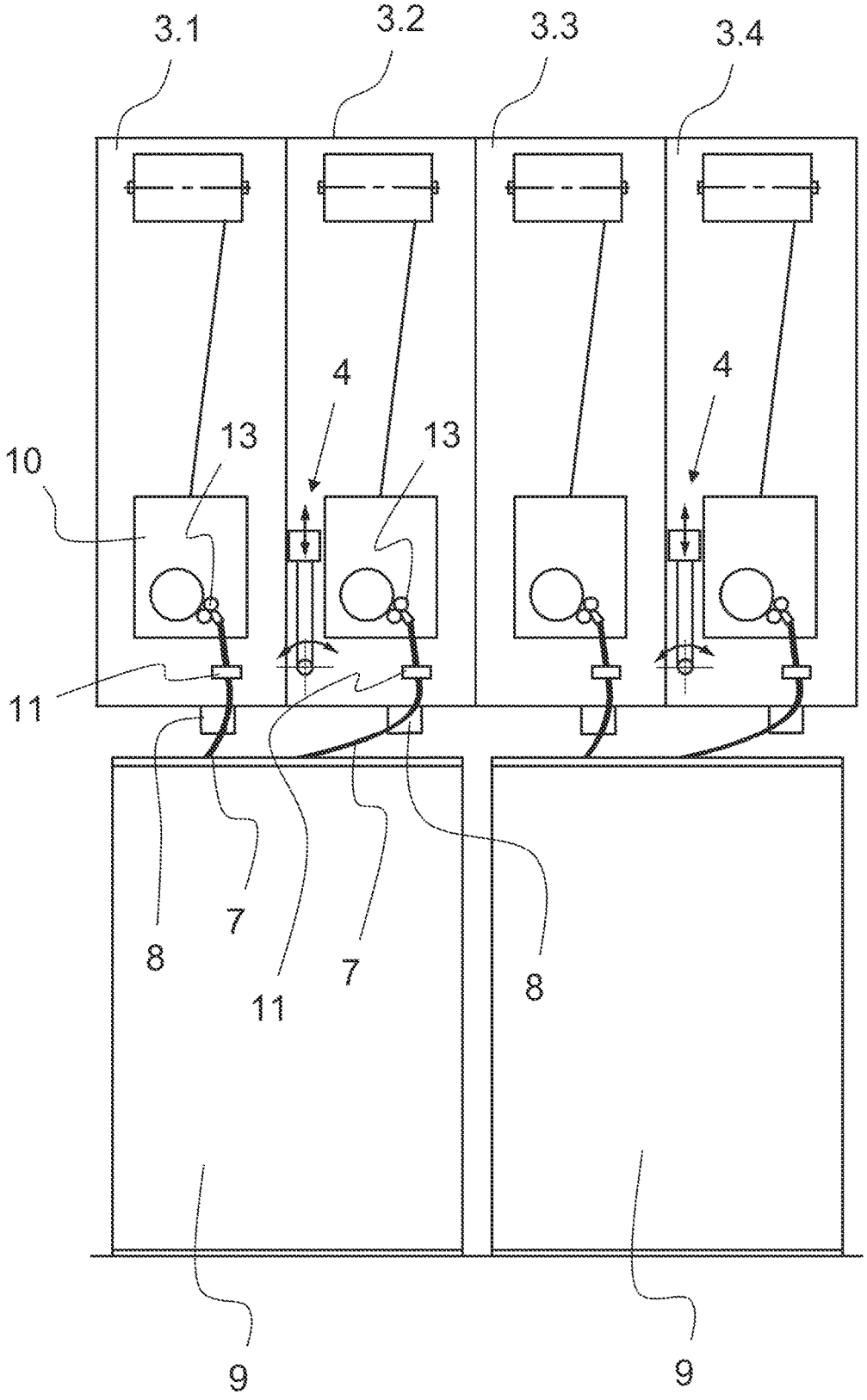
FIG. 4 shows a section of a side view of a spinning machine according to the invention with a piecing device for two adjacent spinning stations.

The section of a side view of a spinning machine 1 according to the invention according to FIG. 4 shows a piecing device 4 for two adjacent spinning stations 3.1 and 3.2 or 3.3 and 3.4. The piecing device 4 is arranged at a spinning station 3.2 and 3.4. Due to the possibility that the piecing device 4 is designed to be rotatable about the rotational axis D toward both sides and, in addition, also includes a variable-length supply device 6, it is capable of ensuring that the fiber bundle 7 can be properly supplied to the particular feed device 13 at both adjacent spinning stations 3.1 and 3.2 or 3.3 and 3.4. Of course, it is also possible that the piecing device 4 is installed in a separate unit 15, as shown in FIG. 3, between two spinning stations 3.1 and 3.2 or 3.3 and 3.4 and, thereby, can serve the spinning stations 3.1 and 3.2 or 3.3 and 3.4 on both sides.

Figure 5:
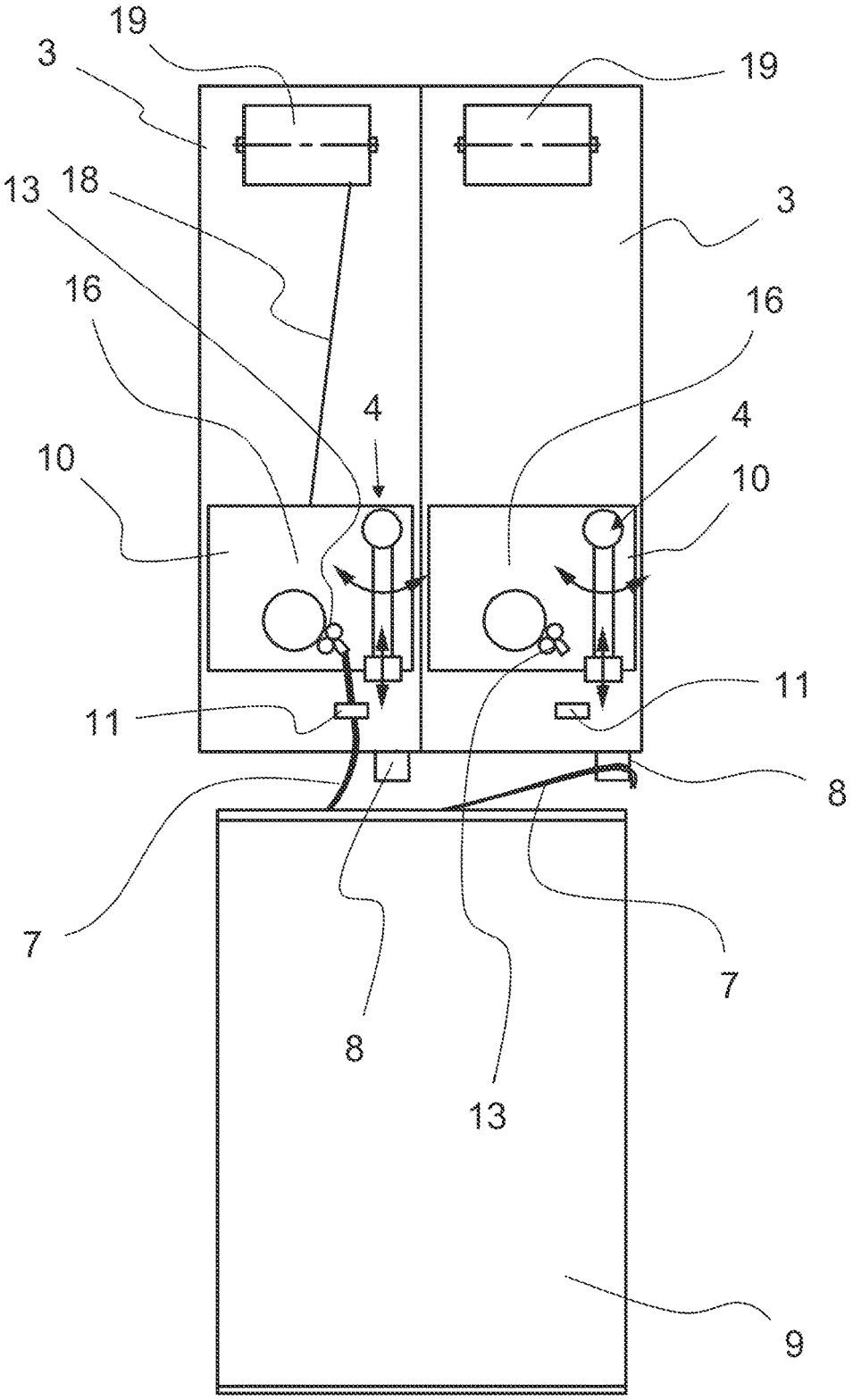
FIG. 5 shows a section of a side view of a spinning machine according to the invention with a piecing device at a cover.

FIG. 5 shows a section of a side view of a spinning machine 1 according to the invention with the piecing device 4 at a cover 16 of the spinning station 3. The cover 16 is capable of carrying out folding movements or linear movements, in order to open the spin box 10 and, for example, in order to enable the rotor to be cleaned or spinning elements to be replaced. This movement of the cover 16 can be utilized in order to be able to transfer an additional movement component onto the piecing device 4. Therefore, for example, the fiber bundle 7, when it is grasped by the piecing device 4, can be moved from the sliver holder 8 to the loop catcher 11 and into the feed device 13, in that not only does the piecing device 4 carry out rotatory or translatory movements, but, additionally, the cover 16 also appropriately moves the piecing device 4 in its entirety.

Figure 6:
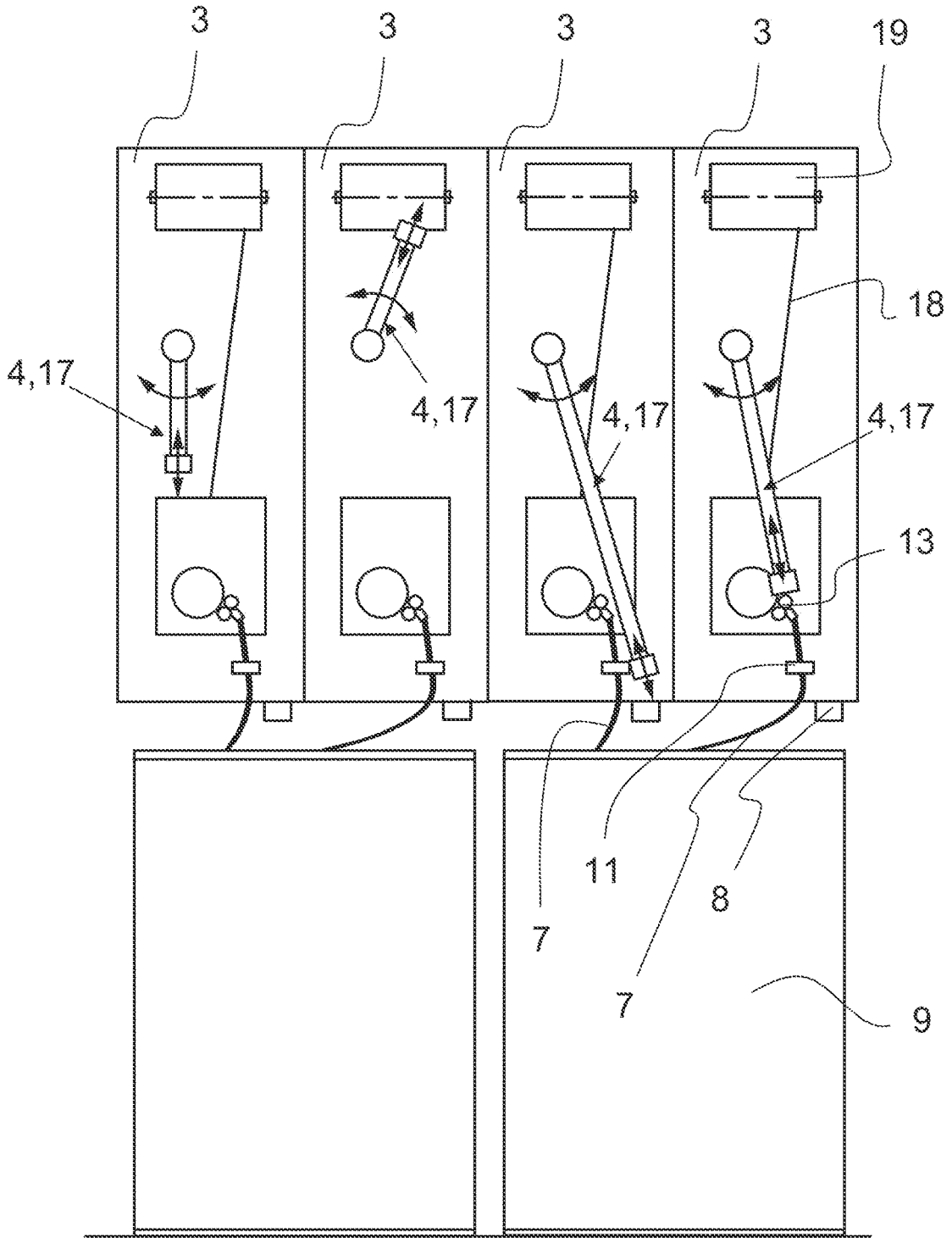
FIG. 6 shows a section of a side view of a spinning machine according to the invention with a piecing device at a thread-handling device.

In FIG. 6, a section of a side view of a spinning machine 1 according to the invention is represented with a piecing device 4 also functioning as a thread-handling device 17. The thread-handling device 17 therefore includes not only the possibility that the thread 18, after a thread break, is grasped from the yarn package 19 and inserted into the spin box 10. The thread-handling device 17 additionally includes the possibility of operating as a piecing device 4 for the fiber bundle 7. For this purpose, the thread-handling device 17 can reach the yarn package 19 as well as the sliver holder 8, the loop catcher 11, and the feed device 13 by means of an appropriate rotatory and translatory movement.

Figure 7:
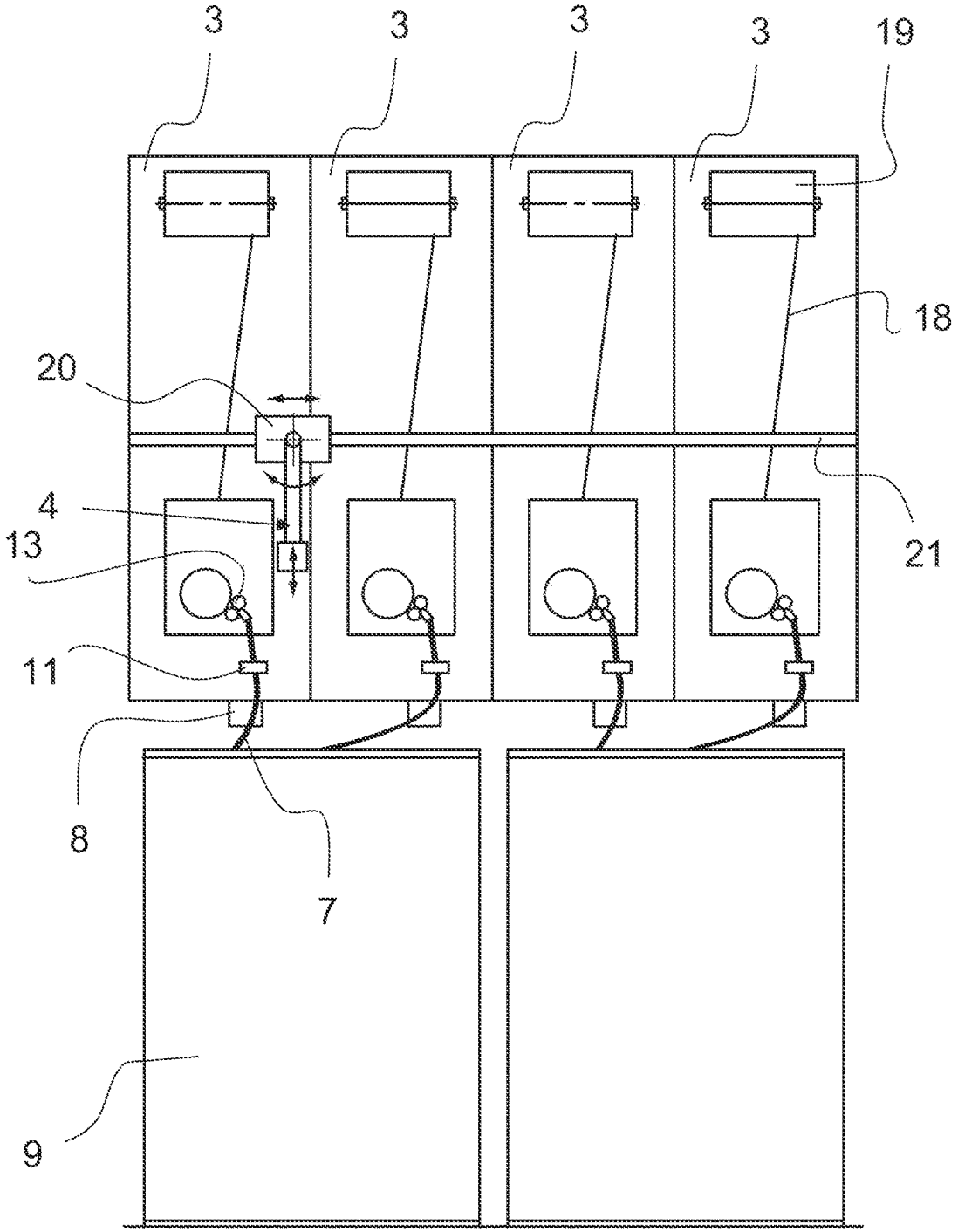
FIG. 7 shows a section of a side view of a spinning machine according to the invention with a piecing device with a displacement device.

FIG. 7 shows a section of a side view of a spinning machine 1 according to the invention with a piecing device 4 and with a displacement device 20. The displacement device 20 is displaceable along a rail guide 21 in such a way that it can reach the individual spinning stations 3.1 through 3.4. According to demand, the displacement device 20 is positioned at the appropriate spinning station 3.1 through 3.4, picks up the fiber bundle 7 from the sliver holder 8 and guides it to the loop catcher 11 and the feed device 13. As soon as the piecing device 4 is needed by this or another spinning station 3.1 through 3.4, to which it is assigned, the displacement device 20 moves the piecing device 4 to the appropriate new position. The rail guide 21 is assigned to a predetermined number of spinning stations 3.1 through 3.4. Preferably, one rail guide 21 is provided, in each case, for spinning stations 3 of one section of the spinning machine 1.

Figure 8:
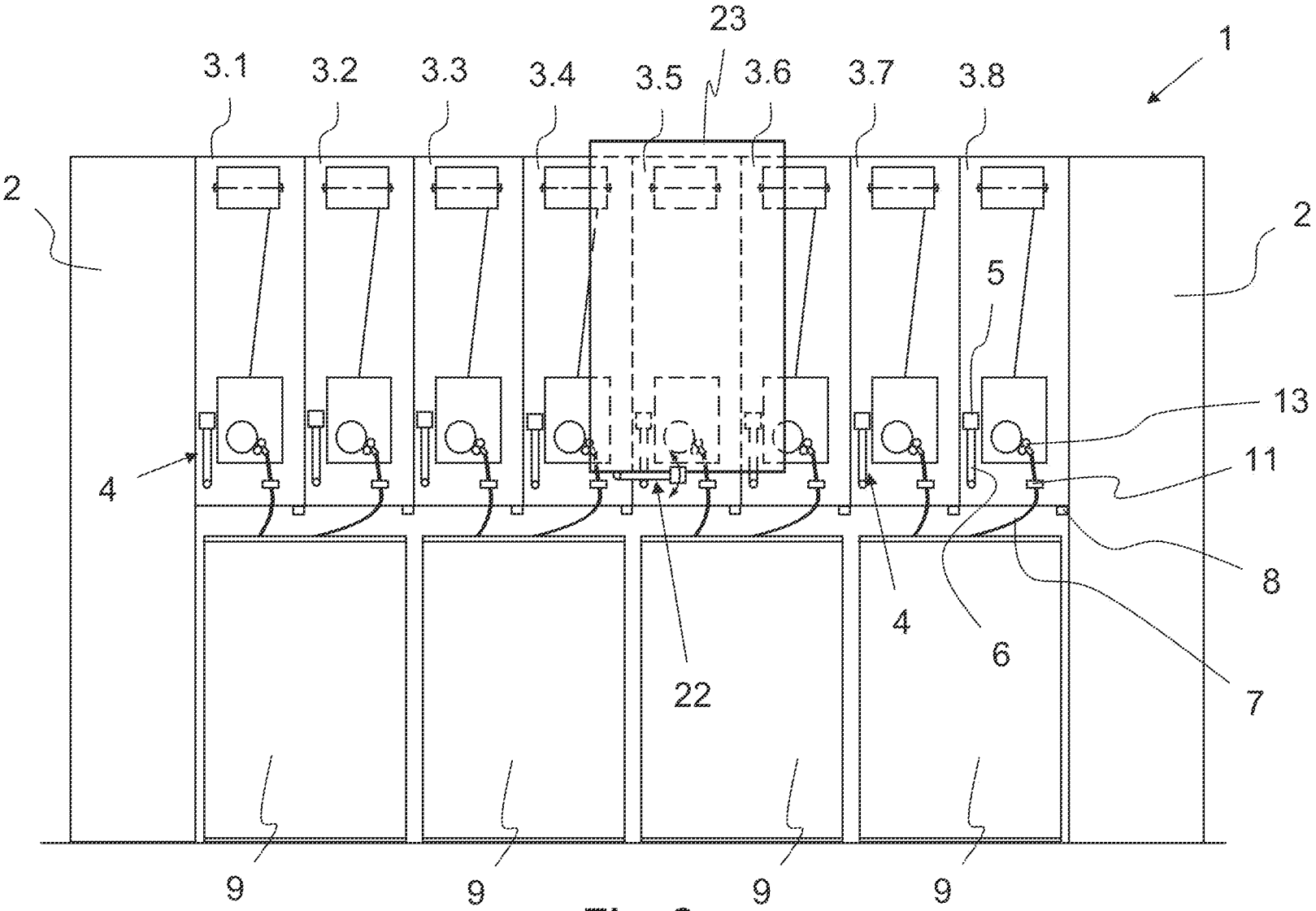
FIG. 8 shows a side view of a spinning machine according to the invention with a piecing device and the cooperation with auxiliary units.

FIG. 8 shows a side view of a spinning machine 1 according to the invention with a piecing device 4 and with an auxiliary unit 22. The auxiliary unit 22 is capable, for example, of carrying out auxiliary tasks for the pick-up and supply of the fiber bundle 7 into the feed device 13. These types of auxiliary tasks are, for example, seeking the fiber bundle 7 at the can 9 and inserting the fiber bundle 7 into the sliver holder 8. The auxiliary unit 22 can carry out rotatory and/or translatory movements. For example, seeking the leading end of the fiber bundle 7 at the can 9 can be very time-consuming. Since this can take place, however, before the spinning station 3 must stop the spinning operation due to a lack of fiber bundle 7, this time requirement is less critical with respect to the efficiency of the spinning station 3. Thereafter, the piecing device 4 of the spinning station 3 is capable of picking up the fiber bundle 7 at the desired time and inserting it into the loop catcher 11 and into the feed device 13.

The auxiliary unit 22 can be arranged, for example, at a maintenance device 23, which patrols along the spinning machine 1 and, as necessary, carries out the auxiliary tasks at the appropriate spinning station 3. In addition, the maintenance device 23 can be provided for further tasks, for example, cleaning the spinning station 3 or changing the yarn package 19 or further tasks during the piecing of a new thread 18 after a thread break.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 spinning machine
2 end stock
3 spinning station
4 piecing device
5 sliver pickup
6 supply device
7 fiber bundle
8 sliver holder
9 can
10 spin box
11 loop catcher
12 insertion device
13 feed device
14 gripper
14*a*, 14*b* jaws
15 unit
16 cover
17 thread-handling device
18 thread
19 yarn package
20 displacement device
21 rail guide
22 auxiliary unit
23 maintenance device
D rotational axis

The invention claimed is:

1. A rotor spinning machine, comprising:

a plurality of adjacently arranged spinning stations, wherein carrier devices for a fiber bundle are assigned to the spinning stations;

each of the spinning stations operating with a fiber bundle feed device and a fiber bundle piecing device;

the fiber bundle piecing device comprising a sliver pickup configured to grasp and pick up a leading end of the fiber bundle supplied from the carrier device and a supply device configured to move the leading end of the fiber bundle to the feed device;

wherein the piecing device with the sliver pickup and the supply device is at a fixed stationary position relative to the spinning stations and is assigned to a single spinning station or a group of spinning stations;

a sliver holder configured at each of the spinning stations, wherein the sliver pickup is configured with the supply device to receive the leading end of the fiber bundle supplied by the carrier device from the sliver holder; and the supply device further configured to extend to a yarn package at the spinning station to retrieve a thread end from the yarn package, thereby also functioning as a thread-handling device at the spinning station.

2. The rotor spinning machine of claim 1, wherein the piecing device comprises an insertion device configured to insert the leading end of the fiber bundle into the feed device.

3. The rotor spinning machine of claim 1, wherein the fiber bundle is a sliver and the carrier devices are one of cans arranged in at least one row at each spinning station or the fiber bundle is a sliver wound onto bobbins.

4. The rotor spinning machine of claim 1, wherein the piecing device is on a separate unit that is arranged between adjacent spinning stations.

5. The rotor spinning machine of claim 1, wherein the piecing device comprises a preparation device that improves the leading end of the fiber bundle for insertion into the feed device.

6. The rotor spinning machine of claim 5, wherein the preparation device comprises one of a pointing device or a splicing device for the leading end of the fiber bundle.

7. The rotor spinning machine of claim 1, wherein the piecing device comprises a sliver separating unit.

8. The rotor spinning machine of claim 1, wherein the piecing device comprises an insertion device configured to insert the leading end of the fiber bundle into the feed device, the sliver pickup and the insertion device arranged on the supply device.

9. The rotor spinning machine of claim 8, wherein the insertion device is pneumatic or mechanical.

10. The rotor spinning machine of claim 1, wherein the supply device is configured with a spin box housing cover at the spinning station.

11. The rotor spinning machine of claim 1, further comprising an auxiliary unit that is displaceable along the spinning stations and configured to perform auxiliary functions by directly engaging the fiber bundle prior to handling of the fiber bundle by the piecing device.

* * * * *